US009747923B2

(12) United States Patent
Salmela

(10) Patent No.: US 9,747,923 B2
(45) Date of Patent: Aug. 29, 2017

(54) VOICE AUDIO RENDERING AUGMENTATION

(71) Applicant: Zvox Audio, LLC, Swampscott, MA (US)

(72) Inventor: Jarl E. Salmela, Swampscott, MA (US)

(73) Assignee: ZVOX AUDIO, LLC, Swampscott, MA (US)

( * ) Notice: Subject to any disclaimer, the term of this patent is extended or adjusted under 35 U.S.C. 154(b) by 81 days.

(21) Appl. No.: 14/689,325

(22) Filed: Apr. 17, 2015

(65) Prior Publication Data

US 2016/0307581 A1 Oct. 20, 2016

(51) Int. Cl.

| | |
|---|---|
| ***H04R 5/00*** | (2006.01) |
| ***G10L 21/034*** | (2013.01) |
| *H04S 3/00* | (2006.01) |
| *H04S 7/00* | (2006.01) |
| *G10L 21/0208* | (2013.01) |
| *G10L 21/0364* | (2013.01) |
| *G10L 21/0272* | (2013.01) |
| *G10L 25/78* | (2013.01) |

(52) U.S. Cl.

CPC ..... *G10L 21/034* (2013.01); *H04S 3/008* (2013.01); *G10L 21/0208* (2013.01); *G10L 21/0272* (2013.01); *G10L 21/0364* (2013.01); *G10L 25/78* (2013.01); *H04S 3/002* (2013.01); *H04S 7/30* (2013.01); *H04S 2400/01* (2013.01); *H04S 2400/05* (2013.01); *H04S 2400/13* (2013.01); *H04S 2420/07* (2013.01)

(58) Field of Classification Search

CPC G10L 21/00; H04R 5/00; H04B 15/00; G06F 15/00; H03F 1/26; H04S 3/00

USPC ..... 381/17, 27, 119, 98, 103, 307; 704/225, 704/258, E21.001, E21.002, 215, 226, 704/500

See application file for complete search history.

(56) References Cited

U.S. PATENT DOCUMENTS

| | | | | |
|---|---|---|---|---|
| 7,171,009 | B2 * | 1/2007 | Ohta | H04S 7/307 381/103 |
| 2007/0027682 | A1 * | 2/2007 | Bennett | G10L 21/0272 704/215 |
| 2008/0049943 | A1 * | 2/2008 | Faller | G10L 19/008 381/17 |
| 2010/0290630 | A1 * | 11/2010 | Berardi | H04S 7/30 381/17 |
| 2011/0119061 | A1 * | 5/2011 | Brown | G10L 19/008 704/258 |

(Continued)

*Primary Examiner* — Vivian Chin
*Assistant Examiner* — Ubachukwu Odunukwe

(57) ABSTRACT

An audio rendering device enhances voice audio such that audible voice is not overwhelmed by other aspects of the soundtrack. The device attenuates right and left channels in an audio stream in response to a detected voice component in the audio stream, and boosts the voice component in the audio stream based on the level of attenuation of the right and left channels. Voice components are distinguished from the non-voice components by separating center channel and mono information from the left, right and surround channels. Non-voice components are attenuated down towards a non-voice threshold level based on an attenuation ratio. Voice components are boosted up toward a voice threshold level, so that the spoken voice is more audible to viewers and not overwhelmed or drowned out by the non-voice aspects of the soundtrack.

17 Claims, 5 Drawing Sheets

(56) References Cited

U.S. PATENT DOCUMENTS

2012/0300941 A1* 11/2012 Shim ..... H04R 5/04
381/1
2013/0006619 A1* 1/2013 Muesch ..... G10L 21/0208
704/225
2014/0219478 A1* 8/2014 Takahashi ..... H04S 1/007
381/119

* cited by examiner

VOICE AUDIO RENDERING AUGMENTATION

BACKGROUND

Televisions were once considered a luxury item, and evolved to a mainstream home appliance such as a refrigerator or stove, and now often occupy multiple rooms in the average home, as well as multiple portable devices suitable for viewing. As televisions (TVs) and associated viewing offerings. The advent of viewer controlled, rather than broadcaster controlled, viewing options introduced by VCRs (Video Cassette Recorders), DVDs, and most recently on-demand and streaming downloads also fueled a market of so-called "Home Theatre" systems. Home theater systems have evolved from simple monaural (mono) add-on speakers, to multi-channel surround sound, to single box virtual surround sound systems. Vendors of home electronics and home theatre components often employ particular encoding schemes to manipulate and direct sound information for achieving "theatre-like" sound in a home environment. Conventional systems generally rely on a "surround sound" encoded audio signal for retrieval of audio information, such as the well-known DOLBY® approaches (2.0 and 5.1 being the most prominent), and endorsed by most producers/vendors of distributed media. Sound encoding separates an audio signal or stream into multiple channels for rendering on different speakers and/or for different ranges of sound, e.g. subwoofer. Many of these conventional systems simply utilize the signal levels as they are encoded, ignoring the fact that the respective levels of these audio channels may be detrimental to reproduction of spoken voice, especially for the hearing impaired, without "riding" the volume control through constant adjustment to compensate for voice inconsistency.

SUMMARY

An audio rendering augmentation device complements a home theatre or multimedia rendering system by boosting audio signals corresponding to voice or spoken components such that audible voice is not overwhelmed by other aspects of the soundtrack. The device employs a method for rendering audio information including attenuating right and left components in a stream of audio information in response to a detected voice component in the audio stream, and boosts or enhances the voice component in the audio stream based on the level of attenuation of the right and left components. The method differentiates the voice components from the non-voice components by separating center channel and mono information from the left, right and surround channels, and attenuates the non-voice components down towards a non-voice threshold level based on an attenuation ratio. The device then boosts the voice components up toward a voice threshold level, such that the voice threshold level is greater than the non-voice threshold level so that the spoken voice is audible to viewers and not dwarfed by the non-voice aspects of the soundtrack. Speakers in the device render the boosted voice component and the attenuated components simultaneously for improving audibility of speech sounds in the audio stream. External connections to other speakers may also be provided.

Configurations herein are based, in part, on the observation that the audio portion, or soundtrack, to a motion picture feature (movie) includes many aspects that can vary in frequency and intensity throughout the feature, resulting from special effects (i.e. explosions, gunfire), vehicles, machinery, crowds of people, spoken dialog and other sounds and sound effects that enhance the overall quality and enjoyment of the feature. Unfortunately, conventional approaches suffer from the shortcoming that certain sound aspects can overwhelm the spoken dialog and make interpretation of spoken language difficult. Some conventional systems have utilized simple techniques such as boosting treble or adding overall signal level compression to help aid in improving voice intelligibility. Though such systems have met with some success, there has been a continuing need for improvement in maintaining intelligibility of spoken dialog throughout the motion picture.

It would be beneficial to provide a sound rendering device for a home theatre system that identifies audio aspects that are likely to "drown out" spoken audio and make intelligibility difficult, and provide a complementary boosting or enhancement such that the character voice aspects of the feature continue to be intelligibly heard. Configurations herein provide a method and apparatus for improving dialog intelligibility in the sound systems built into televisions, or in the home theater surround sound systems used in conjunction with television/video viewing. It may also be applied to any audio system where dialog and spoken voice is being reproduced, including the audio system built into a television set or other audio amplification system where voice intelligibility is sought.

Accordingly, configurations herein substantially overcome the shortcoming of conventional audio rendering in home theater systems by identifying and separating audio information pertaining to the spoken voice audio such as dialog and character voice. The non-voice audio, such as special effects and background sound, is attenuated or reduced toward a predetermined level, while at the same time the voice audio is boosted, or enhanced to permit greater reception and intelligibility by a viewer. Since the non-voice audio is attenuated by an increasing amount as the non-voice audio becomes more intense, and since the voice audio is boosted based on the attenuation level of the non-voice audio, the disclosed approach continually accommodates varying levels and combinations of voice and non-voice audio during a feature and ensures that the voice audio is continually audible by the viewer/user.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
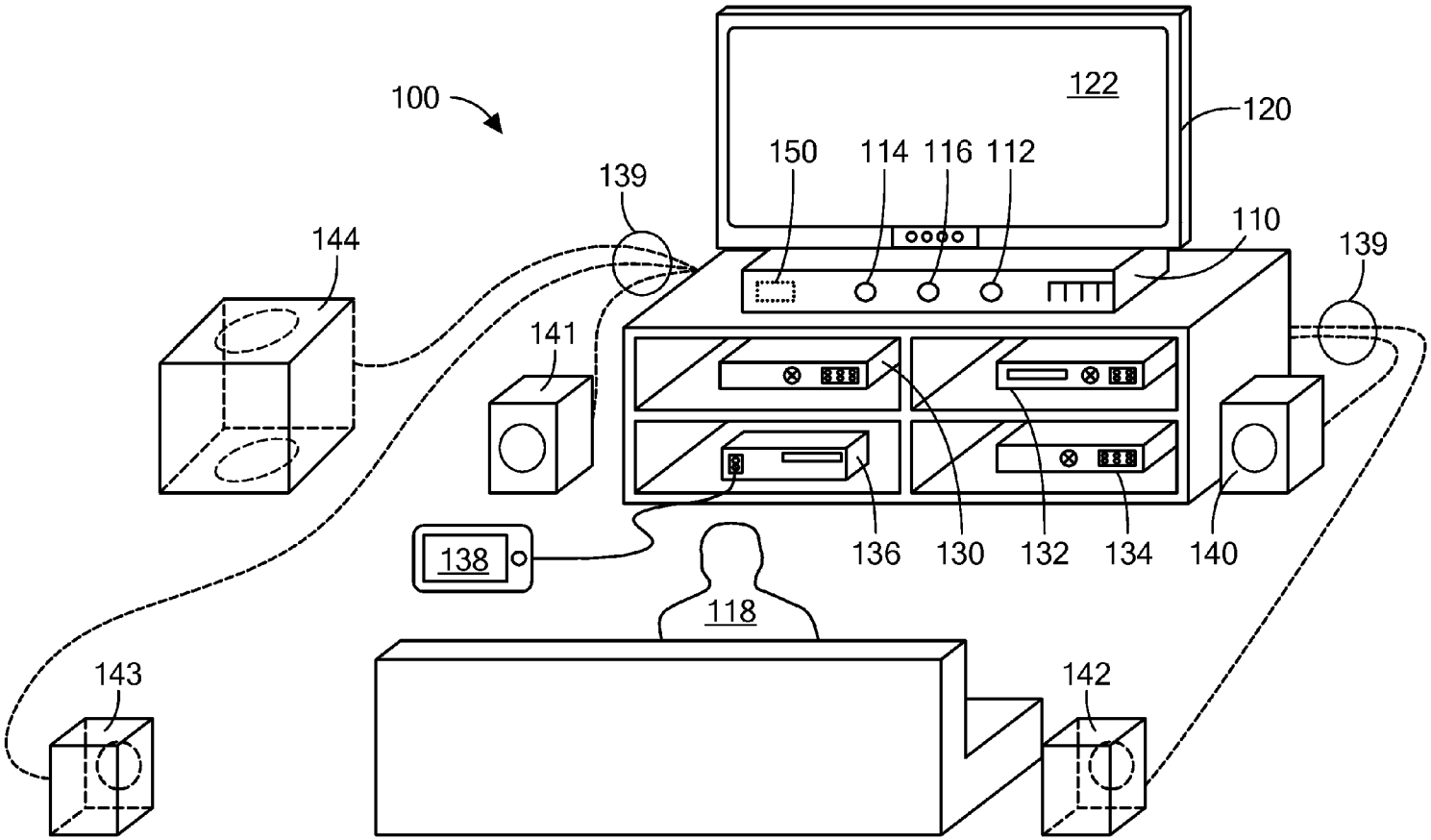
FIG. 1 is a context diagram of an audio rendering environment suitable for use with configurations disclosed herein.

Depicted below are configurations for processing an audio portion of an audiovisual rendering such as a movie or TV show, that performs a method of processing audio by identifying left, right, center and subwoofer components of an audio stream, and determining if a signal level of each of the left, right and subwoofer components, representing a non-voice component, is substantially greater than a signal level of a dialog (voice) component corresponding to spoken voice information in the audio stream. If so, the audio processing attenuates the signal level of the left, right and subwoofer, and also boosts the signal level of the dialog component based on a degree of the attenuation to emphasize the voice component of the movie or TV show over other non-voice (background, special effects, etc.) components that may otherwise tend to drown out or overwhelm the voice and hinder intelligibility.

In general, home theater systems use either discrete speaker and amplifier channels for reproduction of audio soundtracks or combine these functions into integrated one and two box systems with virtualizing algorithms to best capture the surround sound effects and recording as intended by the original sound designers. Some conventional systems convert the multi-channel signal into a 2 channel down mix with proprietary or licensed virtual surround sound recovery algorithms to best reproduce the original intent.

Configurations disclosed herein address reasons why boosting frequencies or leveling the overall volume level as performed in conventional systems is not sufficient for high intelligibility. It was determined that signals not correlated with dialog were decreasing the desired signal to noise ratio of the dialog information. Configurations herein leverage the fact that most dialog information either exists in a discrete center channel signal via a DOLBY® 5.1 encoded audio stream or is mono in nature, should the source material be of one or two channel origin. Configurations herein separate the center channel/mono information from the left, right and surround sound channels. The signals are then sent through separate compressor algorithms with differing output thresholds and variable compression ratios. The compressor algorithm uses a defined output threshold as a point of reference. Should the signal be below the threshold, it will be boosted in order to try and reach the target threshold. If the signal level is higher than the target, the levels will be reduced. However, the defined target points are different for the mono/dialog channel (voice component) than for the left, right and surround information (non-voice) channels. This is the first step in improving the signal to noise ratio of the dialog information. Configurations herein also add a peaked response in the 2-4 KHz octave. The bandwidth, and boost of this peaked band are designed to improve audibility of consonant sounds which play a substantial role in the ability to recognize and understand speech. A great number of people with hearing loss lose it in the higher frequencies where consonant sounds lie. Since the disclosed approach reduces the level of portions of audio information while boosting the dialog information, the system does not simply seem to get louder, as energy is simply traded from one place to another. The overall acoustic power output remains somewhat constant, dependent on the relative amounts of speech to other sound information. Further, speech laden programming is rather common. Movies account for a relatively small percentage of viewership time. Sporting events, news and made-for-TV programming account for substantially more. The greatest benefit is apparent when the overall system volume can be reduced and still maintain intelligibility.

FIG. 1 is a context diagram of an audio rendering environment 100 suitable for use with configurations disclosed herein. Referring to FIG. 1, in a multimedia rendering environment 100, a voice audio augmentation and rendering device 110 performs a method for rendering audio information such as the soundtrack to video entertainment, typically a motion picture (movie). A video display 120, such as a flat screen LCD (Liquid Crystal Display), LED (Light Emitting Diode) display or plasma television having a viewing area 122 renders visual images received from a playback device such as a cable TV settop box 130, DVD/Blu-Ray player 132, broadband/Internet streaming device 134, or a personal computing device (PC) 136, which may optionally receive playback material from a mobile device 138 such as an IPOD® or ANDROID® device. The playback device transmits a multimedia stream including audio and video corresponding to the desired feature. Any suitable origin recognized by the various playback devices may be employed, such as a DVD, device 138 memory, broadband/internet stream, cable broadcast, or other suitable origin. The video display 120 receives and renders the video portion of the multimedia stream, and the voice audio augmentation and rendering device 110 (audio rendering device) receives the audio, or soundtrack portion, either through the video display 120 or directly from the playback device.

The audio rendering device 110 includes speakers 112, 114 and 116, corresponding to right, left and center channels. Generally, the speaker arrangement is not restrictive to the audio rendering methods disclosed herein, and any suitable output arrangement for rendering audio will suffice. However, in a typical arrangement, with a viewer/listener 118 in front of the video display 120, the center speaker 116 is often selected for rendering spoken voice audio, and the right 112 and left 114 speakers for respective right and left channels based on the sound encoding of the feature. The audio rendering device 110 may be standalone, or may be connected with additional audio rendering devices (speakers) in a so-called "surround sound" arrangement, including right speaker 140, left speaker 141, right surround speaker 142, left surround speaker 143, and subwoofer 144. The external speakers may be connected by any suitable transport medium, denoted by dotted lines 139, such as hardwired, WiFi, infrared, or other wireless medium. In the example arrangement shown, the augmented voice is expected to be rendered by the audio rendering device 110 as the center speaker 116 output, hence the associated surround sound arrangement is adaptable. In an example configuration, the audio rendering device may include ACCUVOICE® capability, marketed commercially by Zvox Audio of Swampscott, Mass., assignee of the present application.

Figure 2:
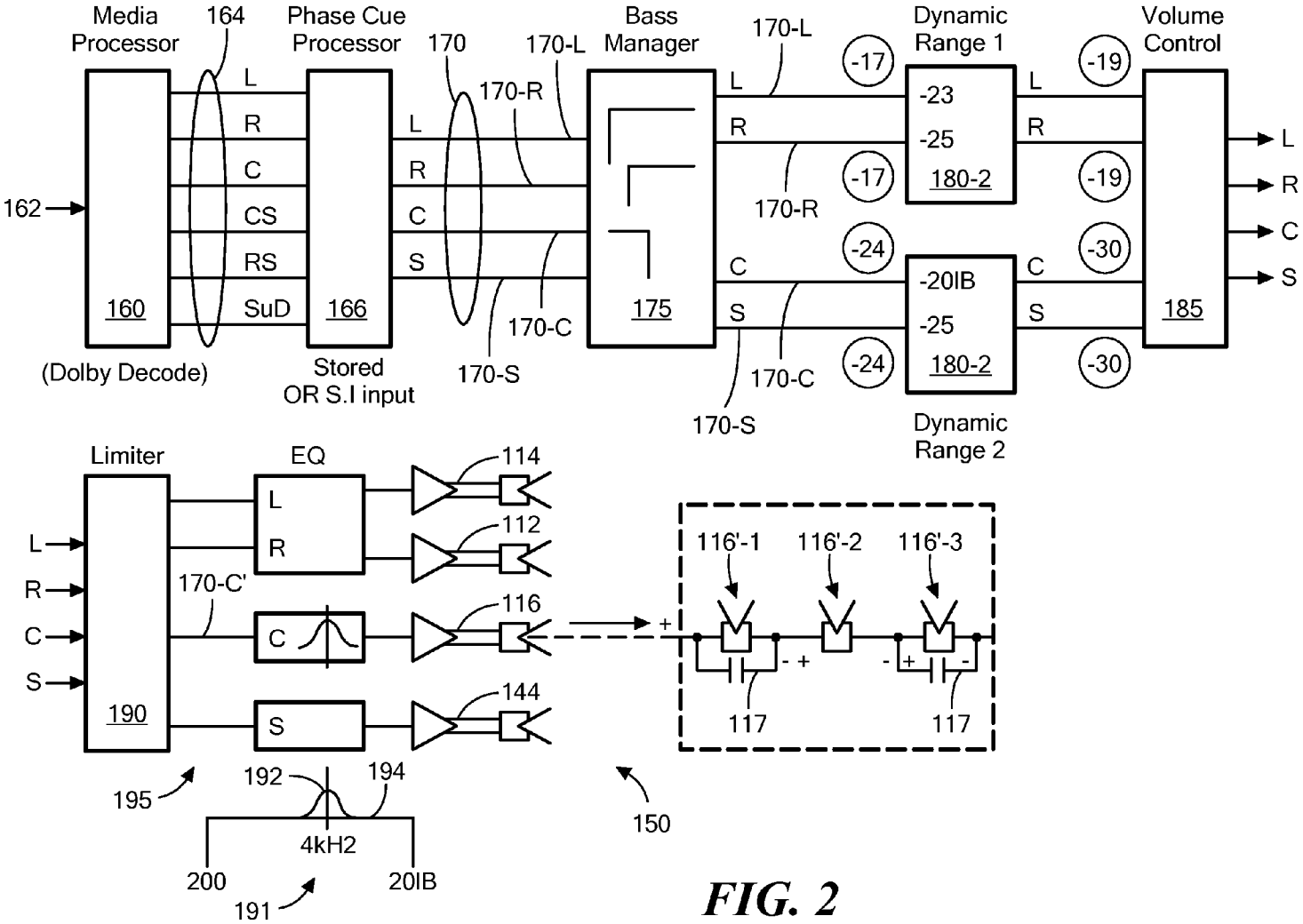
FIG. 2 is a block diagram of an audio rendering and enhancement device in the environment of FIG. 1.

FIG. 2 is a block diagram of an audio rendering and enhancement device in the environment of FIG. 1. Referring to FIGS. 1 and 2, in the environment of FIG. 1, an audio augmentation circuit 150 resides in the audio rendering device 110. The augmentation circuit 150 performs the method for rendering audio information as disclosed herein, and includes components for processing and augmenting the audio portion of the multimedia stream from the playback device. A media processor 160 receives the audio portion 162 of the multimedia stream, and decodes the audio portion 162 according to DOLBY® or other encoding into channels 164. In a typical decoding for surround sound, the channels include left (L), right (R), center (C), left surround (LS), right surround (RS) and subwoofer (SUB), corresponding to the physical speaker arrangement in FIG. 1.

A phase cue processor 168 receives the decoded signals 164, and based on the decoding mechanism, outputs four signals corresponding to right, left, center and subwoofer, 170 collectively. For example, if the encoding was Dolby 5.1, the center channel is already present and is fed through. If Dolby 2.0 was the source, the center channel is derived from information common to both the left and right channels. The resulting signals 170-L, 170-R, 170-C and 170-S are output to a bass manager 175.

The bass manager 175 identifies and processes information used for the subwoofer and other low-frequency sounds and effects. The bass manager 175 separates bass signals from the center channel 170-C, left 170-L and right 170-R channels. The phase cue processor 168 computes monaural (mono) information from information common to both the left and right channels 170-L, 170-R to derive the center channel information. From the bass manager 175, dynamic range processor blocks 180-1 . . . 180-2 (180 generally) perform voice augmentation (attenuation and boosting/enhancing) to emphasize the voice and improve the signal-to-noise ratio of the spoken voice range over the other sound components to generate the augmented voice output as disclosed herein. The number of dynamic range processor blocks 180 may be varied based on the respective inputs/outputs needed and cost factors; the example configuration employs two blocks of two DSP processors, for a total of four.

The dynamic range (DR) processor 180-1 receives the left 170-L and right 170-R channels, and the DR 180-2 receives the center 170-C and sub 170-S channels. The DR processors perform different augmentation on the voice and non-voice components of the audio portion 162. The DRs 180 may also perform dynamic range adjustment timing to adjust the attack and release of the compressed signals relative to the thresholds in order to minimize audible artifacts. Inaudible voice in the audio portion 162 of the feature soundtrack, as disclosed above, results from a mismatch between the SNR of the voice component compared to the non-voice component. Accordingly, separation of the voice component is needed, defined as a band substantially around 4 KHz in a range of 200 Hz to 20 KHz processed by the DRs 180. The dynamic range processors 180 differentiate the voice components from the non-voice components by separating center channel and mono information from the left, right and surround channels.

The dynamic range processors 180 operate to drive certain channels or frequencies to greater or lower levels by increasing or decreasing the strength of the particular signal, typically according to decibel level (dB). When a mismatch between voice and non-voice components is detected, the DRs 180 drive, or boost the voice components up toward a voice target threshold, and attenuate, or dampen, the non-voice components down toward a non-voice target threshold. The degree of boost (signal strength increase) is based on the degree of attenuation, and the voice target threshold is greater than the non-voice target threshold, to generate a stronger output signal for the voice component and a lower volume for the non-voice component. Thus, the DRs 180 boost the voice component in the audio stream 162 based on attenuation of the right and left channels 170-R, 170-L, and render the boosted voice component and the attenuated components simultaneously for improving audibility of speech sounds in the audio stream. The augmented voice component, in the example configuration, is carried in the center channel 170-C, while the non-voice components carried in 170-R, 170-L and 170-S.

A volume control 185 receives the augmented signals 170, and is responsive to a user control for volume adjustment that increases all signals 170 accordingly. The volume control 185 feeds a limiter 190, which limits output volume to avoid distortion. One or more equalizers 195 perform further range adjustment in response to particular user input criteria. The augmented voice 170-C', is now further boosted to add a peaked response in the 2-4 KHz octave 191, typically where spoken dialog and speech occur, as shown by the level 192 of range 194. The voice component is generally defined by an octave substantially around 2-4 KHz and corresponding to spoken consonant sounds in a motion picture soundtrack with interspersed voice and non-voice components. Output speakers 112, 114, 116 and 144 receive the signals 170 for rendering to a user/listener 118.

At the rendering (output) phase, the center speaker 116 may take various implementation forms. The wiring of the center speaker may incorporate a driver array. Three drivers 116'-1, 116'-2 and 116'-3 define the center channel speaker 116. Since around 70% of the signal is mono in nature, it's better to spread the acoustical energy to more reproducers, where possible due to size/cost restraints. A capacitor 117 connects around each of the two outer drivers 116'-1, 116'-3. This has the effect of shunting the high frequencies around the two outside drivers. This places high frequency energy as a point source from only the center speaker in the array. All drivers 116' receive equal energy at frequencies below the cutoff of the R/C filter formed by the capacitors 117 and the drivers 116'. This spreads the low frequency energy among three drivers. The advantages include better power handling, reduced cone motion and consequently, less distortion. A point source for the high frequencies is also beneficial for intelligibility as it prevents comb-filtering of across the horizontal axis. The capacitors 117 also reduce the impedance with increasing frequency. At high frequencies, only the middle driver is active. This type of wiring tends to offset the inductive impedance rise typical of voice coil type loudspeakers.

Figure 3A:
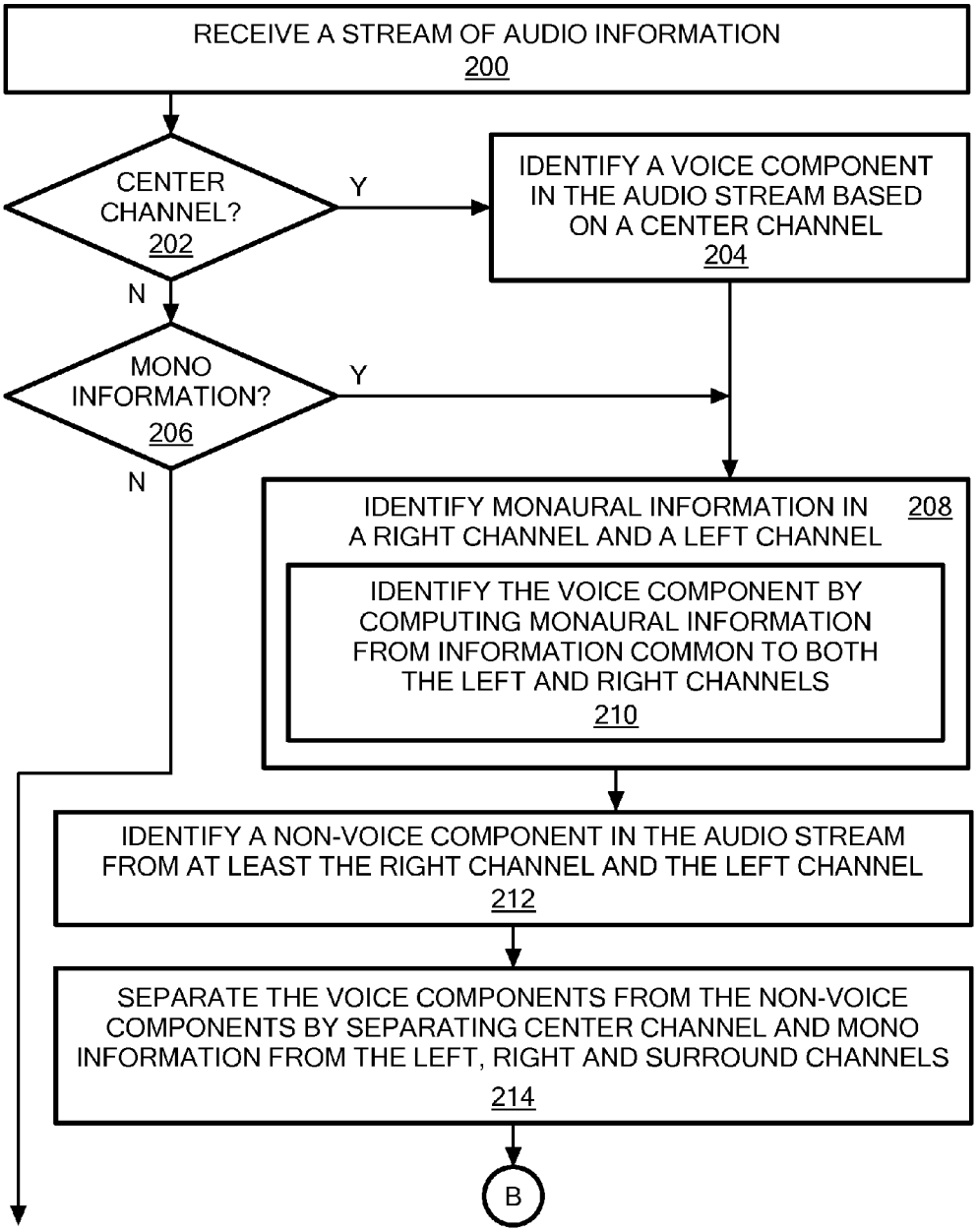
FIGS. 3A-3C are a flowchart of audio processing as disclosed herein.
Figure 3B:
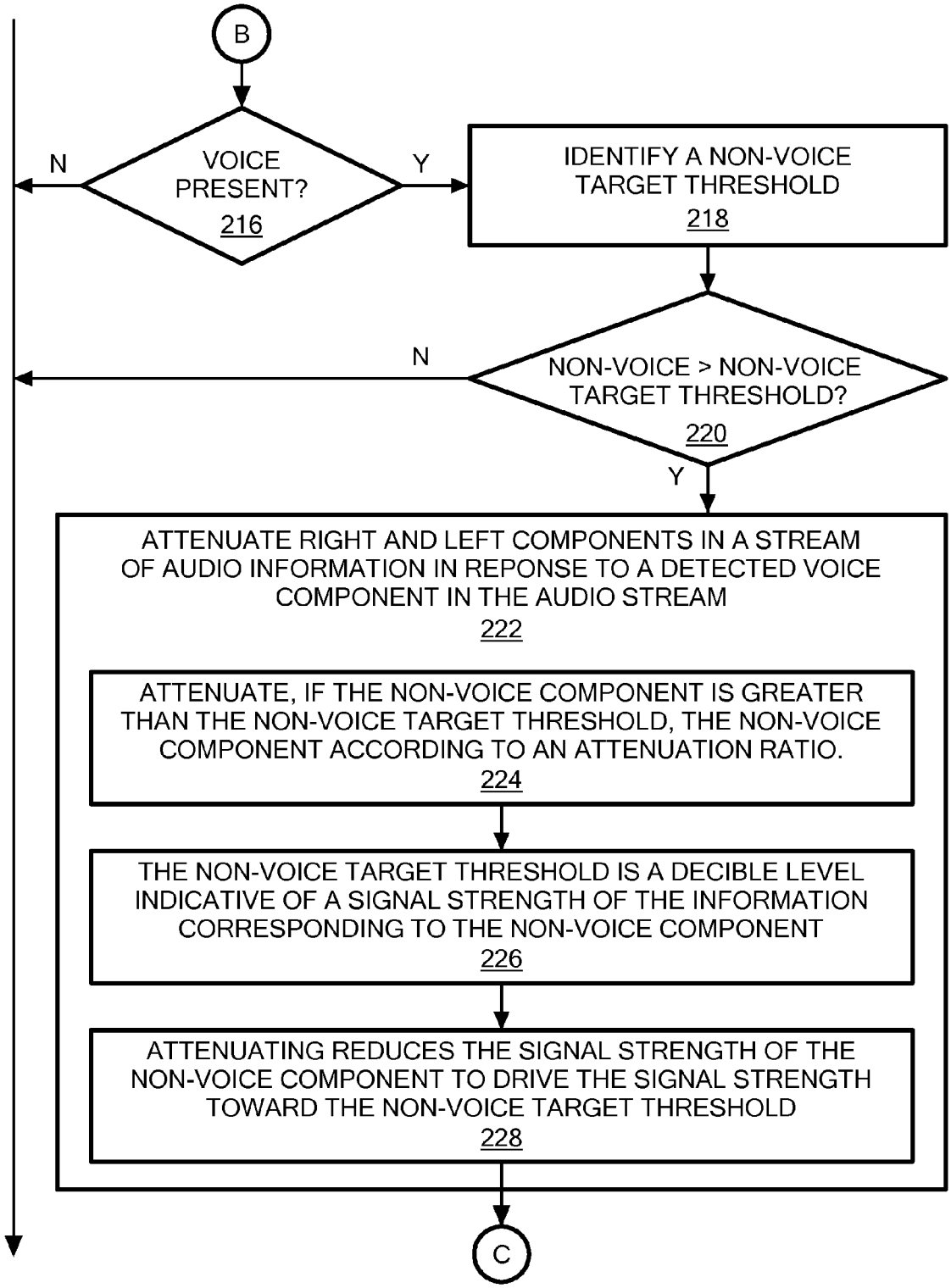
Figure 3C:
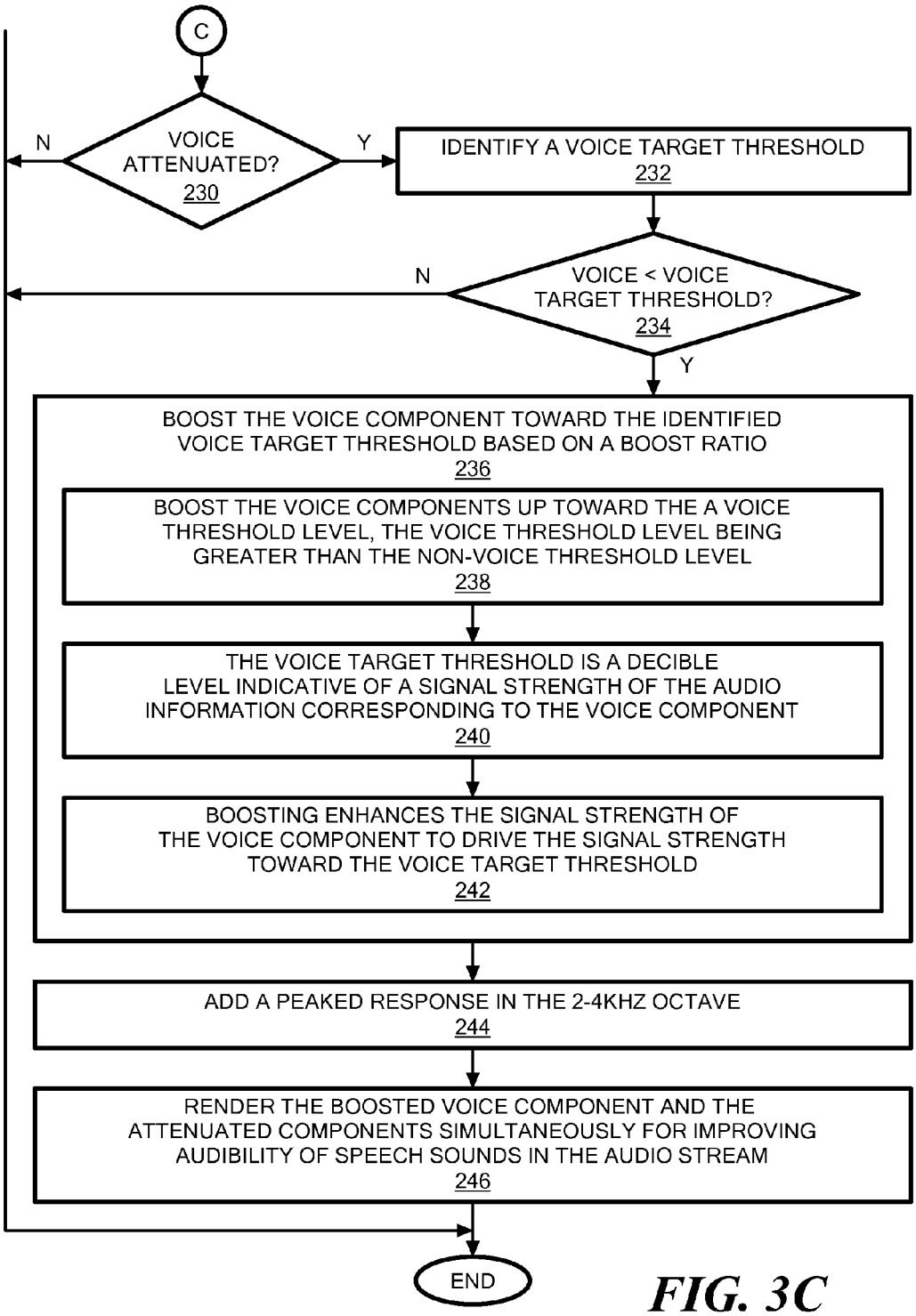

FIGS. 3A-3C are a flowchart of audio processing as disclosed herein. Referring to FIGS. 2 and 3A-3C, at step 200, the audio portion 162 (stream) of the multimedia stream is received, as depicted at step 200. A check is performed, at step 202, to determine if there is center channel information in the stream 162. If so, then the media processor 160 identifies a voice component in the audio stream 162 based on the center channel, as shown at step 204. Another check is performed, at step 206, to determine if monaural (mono) information is present, and accordingly the media processor 160 identifies monaural information in a right channel and a left channel, as depicted at step 208. This includes, at step 210, identifying the voice component by computing monaural information from information common to both the left 170-L and right channels 170-R. Control returns to step 212 as the media processor 162 identifies a non-voice component in the audio stream 162 from at least the center channel 170-C, right channel 170-R and the left channel 170-L.

The phase cue processor 168 receives the audio stream 162, having identified the non-voice component from left surround, right surround and subwoofer channels in the audio stream. 162. The phase cue processor 168 separates the voice components from the non-voice components by separating center channel and mono information from the left, right and surround channels, as depicted at step 214.

At step 216, a check is performed, to identify if a voice component is present in the audio stream 162. If so, the DR 180 identifies a non-voice target threshold, as disclosed at step 218, and a check is performed at step 220 to compare a level of the separated non-voice component to determine if the non-voice component (typically represented by 170-L, 170-R and 170-S) is greater than the non-voice target threshold. If so, then the dynamic range processor 180 attenuates the right 170-R and left 170-L components in the stream 162 of audio information in response to the detected voice component in the audio stream 162, as depicted at step 222. This includes attenuating, if the non-voice component is greater than the non-voice target threshold, the non-voice component according to an attenuation ratio, as depicted at step 224. Such attenuation has the effect of steering the non-voice components down towards the non-voice threshold level based on an attenuation ratio. The attenuation ratio is selected in conjunction with a boost ratio for enhancing the voice component, discussed below. In the example configuration, the non-voice target threshold is a decibel level indicative of a signal strength of the information corresponding to the non-voice component, as shown at step 226, such that attenuation reduces the signal strength of the non-voice component to drive the signal strength toward the non-voice target threshold, as depicted at step 228.

A further check is performed, at step 230, with respect to voice enhancement. The check determines if the non-voice component was attenuated, and if so, the DR 180 identifies a voice target threshold, as depicted at step 232. A further check is performed, at step 234, to determine if the voice component is less that the identified voice target threshold. If so, then the DR 180-2 boosts, or enhances, the voice component in the audio stream based on attenuation of the right and left components 170-L, 170-R by boosting the voice component toward the identified voice target threshold according to a boost ratio, as disclosed at step 236. This includes boosting the voice components up toward the voice threshold level, in which the voice threshold level is greater than the non-voice threshold level, as depicted at step 238. Voice component boosting is expected to be performed in conjunction with non-voice attenuation, however may occur independently. Similarly, the voice target threshold is expected to be greater than the non-voice threshold, to ensure a sufficient enhancement to the user perception of the spoken dialog in the voice component, however particular configurations may operate effectively with other values, discussed further below. Tuning the voice target threshold and the non-voice target threshold may optimize the user listening experience in different circumstances and for different genre of movies.

In the example configuration, the voice target threshold is a decibel level indicative of a signal strength of the audio information corresponding to the voice component, as disclosed at step 240, such that boosting enhances the signal strength of the voice component to drive the signal strength toward the voice target threshold, as depicted at step 242. The equalizer 195, operable to augment and manipulate particular frequency ranges, adds a peaked response in the 2-4 KHz octave, corresponding to most spoken dialog and speech, as disclosed at step 244. The subsequent volume control 185, limiter 190, equalizer. The speakers 112, 114, 116 and 144 or other rendering devices render the boosted voice component and the attenuated components simultaneously for improving audibility of speech sounds in the audio stream 162, as depicted at step 246.

In the example configuration, the boost ratio has the same magnitude as the attenuation ratio, such as 4:1, thus attenuating the non-voice a similar degree as the voice is boosted, however alternate magnitudes may be employed. It has been found that a voice target threshold substantially around 5 dB greater than the non-voice target threshold produces favorable results, such as a non-voice threshold of −25 dB and a voice threshold of −20 dB, however alternate values may be employed. The voice component is expected to be defined by an octave substantially around 2-4 KHz and corresponding to spoken consonant sounds in a motion picture soundtrack with interspersed voice and non-voice components.

As an example, consider the following scenario, employing a non-voice threshold of −25 dB and a voice threshold of −20 dB, an attenuation ratio of 4:1 and a boost ratio of 4:1. Referring again to FIG. 2 (circled quantities), the left and right channels 170-L, 170-R are at −17 dBs respectively, the center (voice) channel 170-C is at −24, and the subwoofer 170-S at −30 dB. Applying voice augmentation to the right and left considers that the level of −17 dB is above the non-voice threshold of −25 dB, so attenuation reduces the level to −19 dB. The center (voice) channel 170-C is at −24 dB, below the voice threshold of −20 dB, and accordingly is boosted to −23 dB. The subwoofer channel 170-S, already below the non-voice threshold at −30 dB, is not attenuated.

Those skilled in the art should readily appreciate that the system and methods defined herein are deliverable to a computer processing and rendering device in many forms, including but not limited to a) information permanently stored on non-writeable storage media such as ROM devices, b) information alterably stored on writeable non-transitory storage media such as floppy disks, magnetic tapes, CDs, RAM devices, and other magnetic and optical media, or c) information conveyed to a computer through communication media, as in an electronic network such as the Internet or telephone modem lines. The operations and methods may be implemented in a software executable object or as a set of encoded instructions for execution by a processor responsive to the instructions. Alternatively, the operations and methods disclosed herein may be embodied in whole or in part using hardware components, such as Application Specific Integrated Circuits (ASICs), Field Programmable Gate Arrays (FPGAs), state machines, controllers or other hardware components or devices, or a combination of hardware, software, and firmware components.

While the methods and apparatus defined herein have been particularly shown and described with references to embodiments thereof, it will be understood by those skilled in the art that various changes in form and details may be made therein without departing from the scope of the invention encompassed by the appended claims.

What is claimed is:

1. In a multimedia rendering environment, a method for rendering audio information comprising:

differentiating voice components from non-voice components by separating center channel and mono information from left, right and surround channels in a stream of audio information;

detecting the voice component by computing monaural information from information common to both the left and right channels;

identifying the non-voice component from left surround, right surround and subwoofer channels in the audio stream;

attenuating right and left components in the stream of audio information in response to the detected voice component in the audio stream by attenuating the non-voice components, and boosting the voice component in the audio stream up toward a voice threshold level based on attenuation of the right and left components, the voice threshold level being greater than a non-voice threshold level; and rendering the boosted voice component and the attenuated components simultaneously for improving audibility of speech sounds in the audio stream.

2. The method of claim 1 further comprising:

identifying a voice component in the audio stream based on a center channel and monaural information in a right channel and a left channel; and identifying a non-voice component in the audio stream from at least the right channel and the left channel.

3. The method of claim 1 further comprising:
identifying a non-voice target threshold;
attenuating, if the non-voice component is greater than the non-voice target threshold, the non-voice component according to an attenuation ratio.

4. The method of claim 3 further comprising
identifying a voice target threshold;
determining if the non-voice component was attenuated, and if so,
boosting the voice component toward the identified voice target threshold based on a boost ratio.

5. The method of claim 4 wherein the boost ratio has the same magnitude as the attenuation ratio.

6. The method of claim 4 wherein
the non-voice target threshold is a decibel level indicative of a signal strength of the information corresponding to the non-voice component;
attenuating reduces the signal strength of the non-voice component to drive the signal strength of the non-voice component toward the non-voice target threshold;
the voice target threshold is a decibel level indicative of a signal strength of the audio information corresponding to the voice component, and
boosting enhances the signal strength of the voice component to drive the signal strength toward the voice target threshold.

7. The method of claim 6 wherein the voice target threshold is substantially around 5 dB greater than the non-voice target threshold.

8. The method of claim 4 wherein the voice component is defined by an octave substantially around 2-4 KHz and corresponding to spoken consonant sounds in a motion picture soundtrack with interspersed voice and non-voice components.

9. The method of claim 4 further comprising adding a peaked response in an octave substantially around 2-4 KHz and corresponding to spoken dialog and speech.

10. A method of processing audio, comprising:
identifying left, right, center and subwoofer components of an audio stream;
differentiating voice components from non-voice components by separating center channel and mono information from left, right and surround channels in the audio stream;
detecting the voice component by computing monaural information from information common to both the left and right channels;
identifying the non-voice component from left surround, right surround and subwoofer channels in the audio stream;
determining if a signal level of each of the left, right and subwoofer components is substantially greater than a signal level of a dialog component corresponding to spoken voice information in the audio stream, and if so,
attenuating the signal level of the left, right and subwoofer down towards a non-voice threshold level based on an attenuation ratio; and
boosting the signal level of the dialog component up toward a voice threshold level based on a degree of the attenuation.

11. The method of claim 10 further comprising identifying a voice component from a center channel and monaural components in the right and left channels, the monaural components based on duplicated information in the right and left channels.

12. The method of claim 11 further comprising increasing the strength of the dialog component in an octave substantially around 2-4 KHz and corresponding to spoken dialog and speech.

13. A voice audio augmentation device, comprising:
a media processor adapted to receive a stream of audio information and identify left, right and center channels;
a phase cue processor configured to differentiate the voice components from the non-voice components by
separating center channel and mono information from the left, and right channels;
detecting the voice component by computing monaural information from information common to both the left and right channels; and
identifying the non-voice component from left surround, right surround and subwoofer channels in the audio stream;
a dynamic range processor configured to:
identify a non-voice target threshold;
attenuate the right and left components in response to detecting the voice component in the audio stream by attenuating, if the non-voice component is greater than the non-voice target threshold, the non-voice component according to an attenuation ratio,
identify a voice target threshold;
determine if the non-voice component was attenuated, and if so,
boost the voice component in the audio stream toward the identified voice target threshold based on a boost ratio and the attenuation of the right and left components; and
render the boosted voice component and the attenuated components simultaneously for improving audibility of speech sounds in the audio stream.

14. The device of claim 13 further comprising:
a non-voice target threshold defined by a decibel level indicative of a signal strength of the information corresponding to the non-voice component, the dynamic range processor further configured to attenuating reduces the signal strength of the non-voice component to drive the signal strength of the non-voice component toward the non-voice target threshold;
a voice target threshold defined by a decibel level indicative of a signal strength of the audio information corresponding to the voice component, the dynamic range processor further configured to boost the signal strength of the voice component to drive the signal strength toward the voice target threshold.

15. The device of claim 14 wherein the voice target threshold is substantially around 5 dB greater than the non-voice target threshold.

16. The device of claim 13 further comprising an equalizer configured to add a peaked response in an octave substantially around 2-4 KHz and corresponding to spoken dialog and speech.

17. The method of claim 1 wherein the attenuated non-voice components are rendered through left and right speakers, and the boosted voice components are rendered through center channel speakers.

* * * * *